United States Patent [19]

Weetman

[11] Patent Number: 4,802,771

[45] Date of Patent: Feb. 7, 1989

[54] MIXING APPARATUS

[75] Inventor: Ronald J. Weetman, Rochester, N.Y.

[73] Assignee: General Signal Corp., Stamford, Conn.

[21] Appl. No.: 846,372

[22] Filed: Mar. 31, 1986

[51] Int. Cl.[4] ..... B01F 5/12; B01F 7/22; F04D 29/18

[52] U.S. Cl. ..... 366/270; 366/330; 416/236 A

[58] Field of Search ..... 366/330, 343, 262, 270, 366/279; 416/236 R, 236 A, DIG. 2; 415/52, 53 R, 212 R, 213 R, 213 A, 213 C

[56] References Cited

U.S. PATENT DOCUMENTS

| | | | |
|---|---|---|---|
| 725,877 | 4/1903 | Rommeney | 366/270 X |
| 1,518,501 | 12/1924 | Gill | 415/213 C |
| 1,882,164 | 10/1932 | Ross . | |
| 2,014,032 | 9/1935 | Sharpe . | |
| 2,027,647 | 1/1936 | Montgomery | 415/213 C X |
| 2,191,341 | 2/1940 | Curley | 415/213 C |
| 2,581,873 | 1/1952 | Morrison . | |
| 3,023,709 | 3/1962 | Kondo . | |
| 3,447,382 | 11/1969 | Watson . | |
| 3,572,658 | 3/1971 | Ravittes | 366/330 X |
| 4,147,437 | 4/1979 | Jonqueres | 366/343 |
| 4,288,223 | 9/1981 | Gonzalez et al. | 416/236 A X |
| 4,459,030 | 1/1984 | Weetman | 366/262 |
| 4,468,130 | 8/1984 | Weetman | 366/330 |
| 4,571,090 | 2/1986 | Weetman et al. | 366/270 |

*Primary Examiner*—Harvey D. Hornsby
*Assistant Examiner*—Scott J. Haugland
*Attorney, Agent, or Firm*—Martin Lukacher; J. S. Mednick

[57] ABSTRACT

Apparatus for mixing or circulating a liquid or a liquid suspension (slurry) to provide efficiently, high head so as to enable slurries which are viscous or contain large or heavy particles or tend to agglomerate to be mixed or circulated, uses an impeller which provides a head coefficient, $k_v$ from about 3 to 10 at high hydraulic efficiency. The impeller has a plurality of blades with a tip configuration which develops the high head where the blades are wider at the tip than at the base and have fins disposed above and below the blades and at the way of a draft tube wherein axial flow is produced.

15 Claims, 5 Drawing Sheets

MIXING APPARATUS

The present invention relates to apparatus for mixing or circulating liquid or liquid suspension media, and particularly to mixing apparatus having an impeller which develops high pressure or head at high hydraulic efficiency.

The invention is especially suitable for use in industrial mixing applications for mixing or circulating slurries which may be viscous or contain large particles or which tend to agglomerate. The impeller provided by the invention is capable of developing a high head without close clearances between the blades and surrounding structure for passage of particles of the slurry which would ordinarily erode the blades and reduce their head capacity and life.

It has been discovered, in accordance with the invention that high hydraulic efficiencies, the ratio of the product of flow and head across the impeller to the drive shaft input power, (greater than 40%) may be provided by configuring the blades of the mixing impeller to provide a head coefficient, $k_v$ from about 3 to 10, where $$k_v = \frac{H_d}{V^2/2g}$$

In this equation, $H_d$ is the pressure head across the impeller, V is the average flow velocity of the medium across the diameter of the impeller, and g is the acceleration of gravity. The denominator of the $k_v$ expression is the dynamic velocity head. The coefficient therefore takes into account both pressure and velocity.

Conventional impellers are not capable of efficiently providing flow at $k_v$ of 3 and above in that excessive power is required to rotate the impeller. Even high rotation speeds are insufficient because of separation of the medium from the impeller blades in the high $k_v$ regime.

It has been found in accordance with the invention that high $k_v$ can be obtained by configuring the impeller blades so that their tip regions are capable of developing high head without separation at reasonable flow efficiencies in that the tip region is primarily responsible for developing the head. The impeller is provided with a plurality of blades, preferably 3 or more blades, each of which preferably having a width at the tip wider than at the base. Preferably, the width of the blade measured between the corners thereof at the tip and at the base, defined in accordance with the ratio of the width to the diameter of the impeller W/D (the diameter of the circle circumscribed by the impeller) is in the range of 0.4 to 0.25 at the tip while the base W/D ratio is between 0.3 and 0.2. Each tip is provided with a fin which extends above and below the opposite surfaces of the blade. Preferably the fins are symmetrically disposed on the tip, specifically the upper and lower edges of the fin are equally distant from the intersection of the midline and the leading and trailing edge of the blade.

A draft tube coaxial with the impeller and having an annular way or channel is provided. The fins extend into and are recessed within the way. The blades preferably have camber and twist. Because of the blade tip configuration including the fins, circulation of the medium in a direction opposite to the axial flow direction is inhibited and the blade tips are made capable of providing the pressure and dynamic velocity heads with $k_v$ in the range from 3 to 10. The draft tube also controls the flow in the way whereby the blades, fins and way are not affected by significant flow of particles which can erode the blades or the fins. The impeller system thereby is capable of the development of high heads over a long impeller lifetime.

There have been proposed various fin configurations having blades which are wider at the tip than at the base (see U.S. Pats. Nos. 3,023,709 issued Mar. 6, 1962; 2,581,873 issued Jan. 8, 1952; and 1,882,164 issued Oct. 11, 1932). Various impeller configurations utilizing fins, for flow direction and stabilization have also been described (see U.S. Pats. Nos. 4,468,130 issued Aug. 28, 1984; 2,041,032 issued Sept. 10, 1935; and 4,147,437 issued Apr. 3, 1979). Various mixers using draft tubes with ways have in the past been used and described (see U.S. Pats. Nos. 3,477,382 issued Nov. 11, 1969; 4,459,030, issued July 10, 1984 and 4,571,090 issued Feb. 18, 1986). Such prior art has not recognized, the problem of providing high head operation let alone any means for efficiently providing axial flow and a head coefficient $k_v$ in the range from 3 to 10 at high hydraulic efficiencies.

It is therefore a principal object of the present invention to provide improved mixing apparatus having an impeller which is capable of providing high heads at high hydraulic efficiencies.

It is a further object of the present invention to provide a high head impeller system which produces a head coefficient $k_v$ from about 3 to 10.

It is a still further object of the present invention to provide improved mixing apparatus utilizing a draft tube which is capable of providing high heads in a head coefficient, $k_v$, range of from about 3 to 10.

It is a still further object of the present invention to provide an improved high head impeller system, the lifetime of which is not severely impacted by erosion, for example due to abrasive particles in the slurry being mixed or circulated by the system.

The foregoing and other objects, features and advantages of the invention as well as a presently preferred embodiment thereof will become more apparent from a reading of the following description in connection with the accompanying drawings in which.

Figure 1:
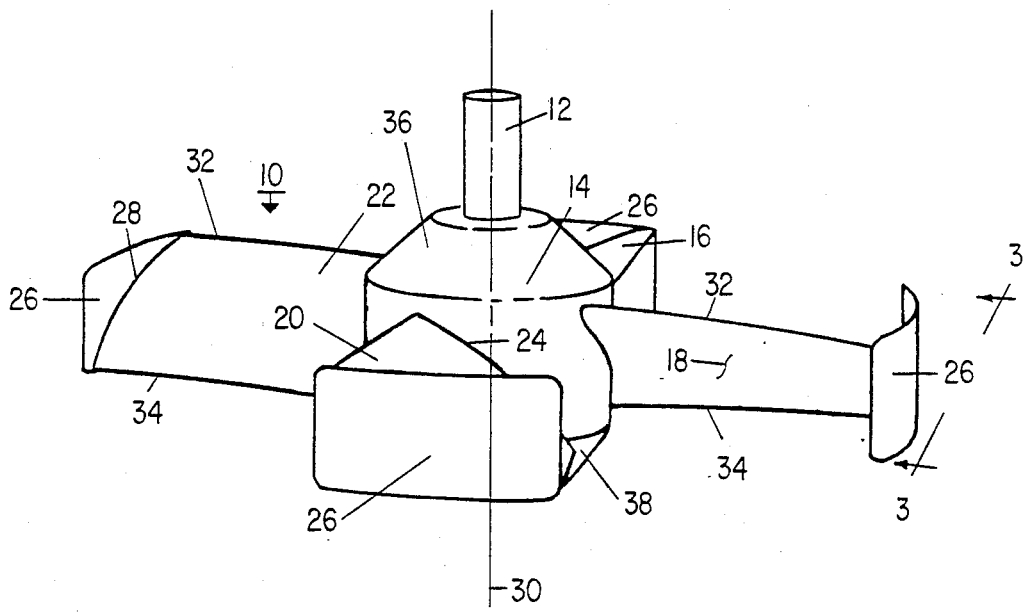
FIG. 1 is a perspective view of an impeller system in accordance with the presently preferred embodiment of the invention.
Figure 2:
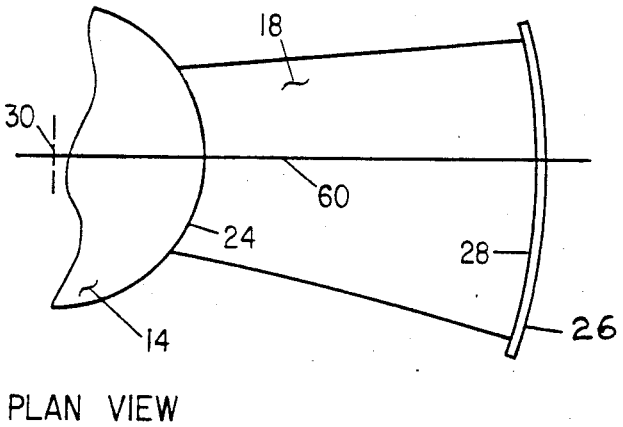
FIG. 2 is a plan view showing a blade of the impeller system illustrated in FIG. 1.
Figure 3:
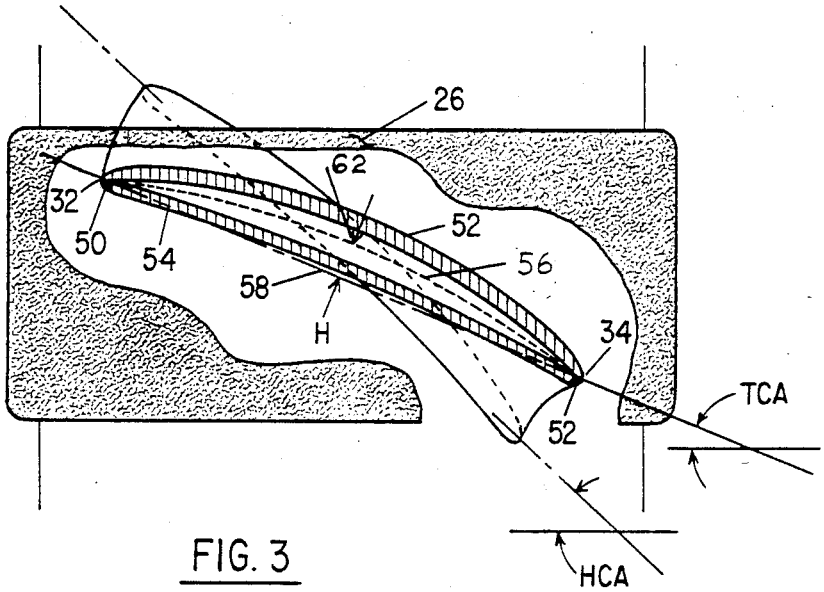
FIG. 3 is an end view of the tip region of one of the blades with the fin broken away to show the end of the tip.
Figure 4:
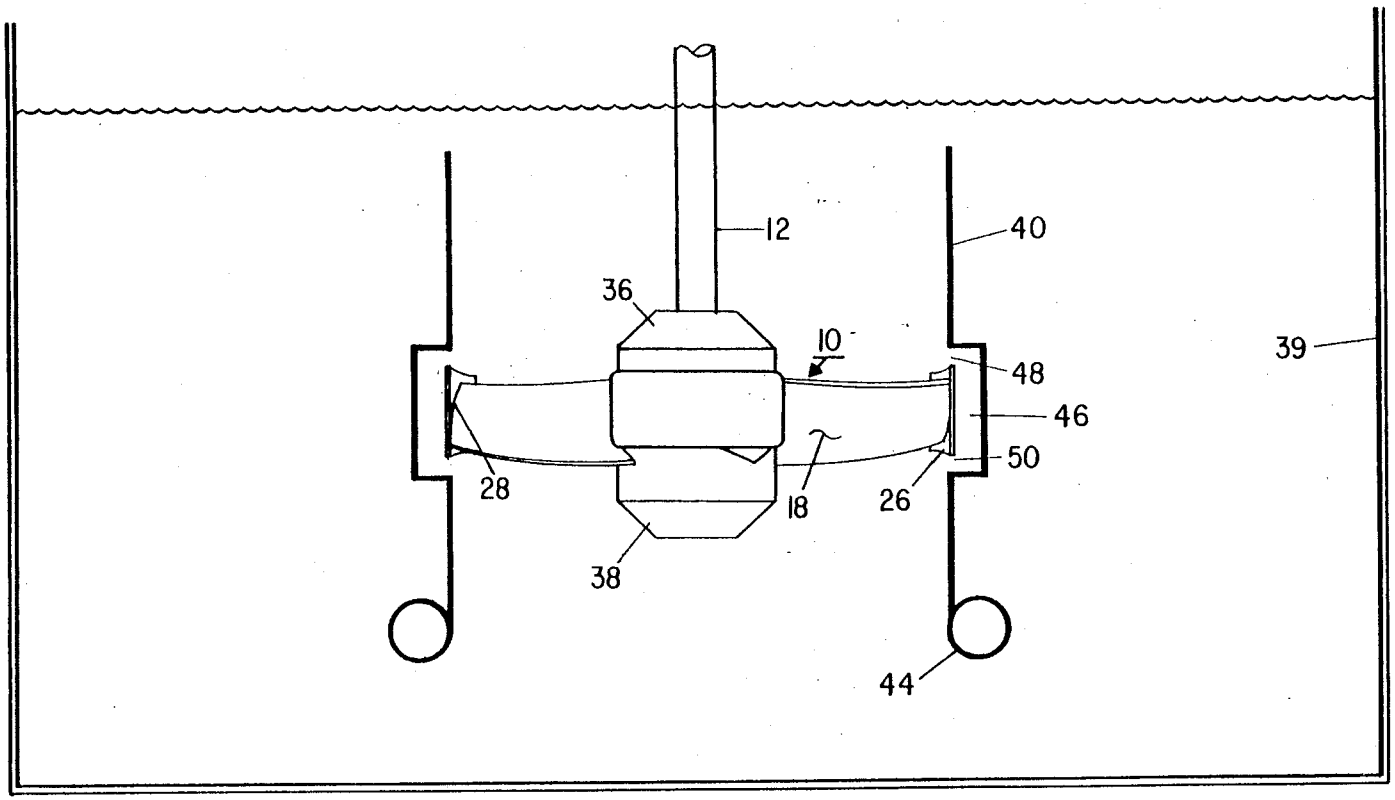
Figure 5:
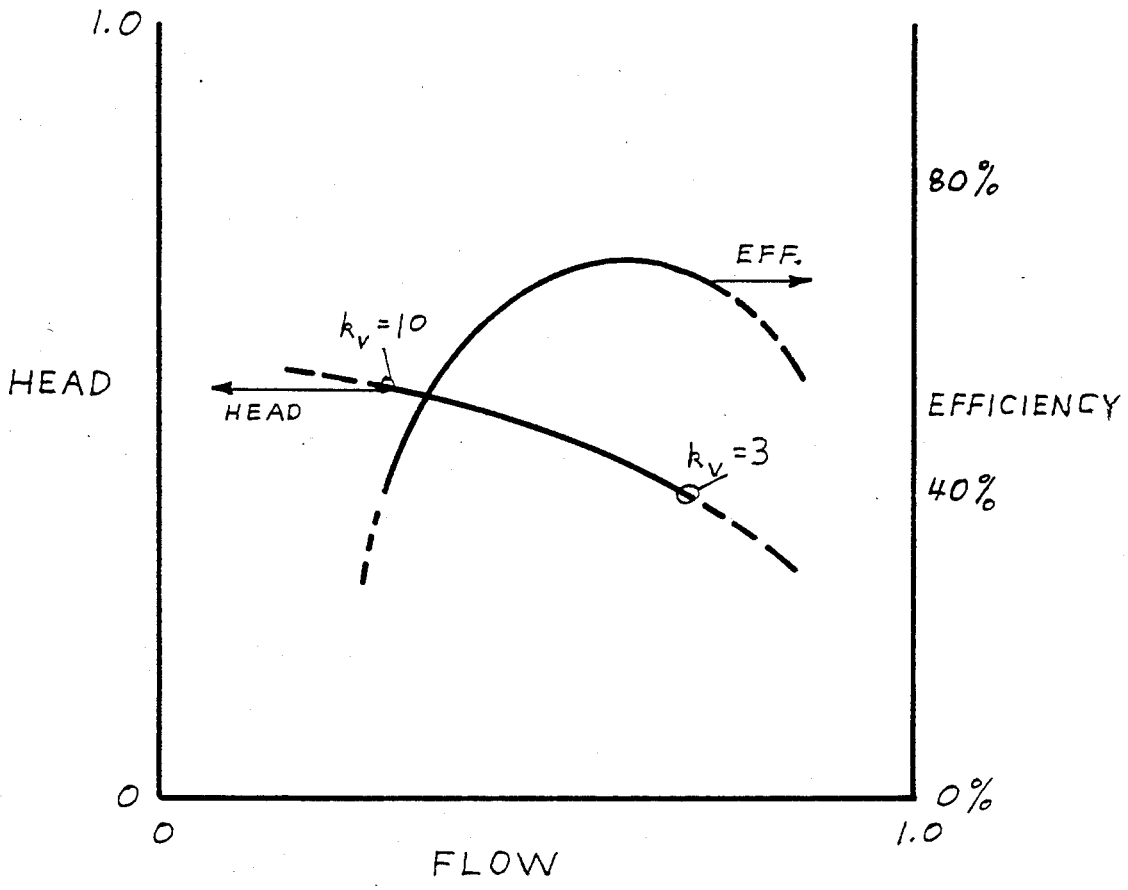

FIG. 4 is a sectional view illustrating the impeller shown in FIGS. 1 through 3 in a draft tube disposed in a tank, and adapted to circulate the medium upwardly through the draft tube, the upper portion of the tank and the means for supporting the impeller and the draft tube being omitted to simplify the illustration; and FIG. 5 shows head vs. flow and efficiency vs. flow curves for the impeller system shown in FIGS. 1–4 over a $k_v$ range of from 3–10.

Referring more particularly to FIG. 1 there is shown an impeller system 10 which is rotated by a shaft 12 coupled to a gear box and drive motor (not shown). The shaft 12 is connected to a hub 14. Four blades 16, 18, 20 and 22 are attached at their bases 24 to the hub 14. The blades are 90° apart. Three or more blades may be used.

If three blades are used they are attached to the hub 120° apart. If more than 4 blades are used they are attached to the hub spaced by equal angular distances.

Fins 26 are connected to the tips 28 of the blades 16, 18, 20 and 22. The impeller is rotated about a vertical axis 30 which is the axis of the shaft 12 and the hub 14. The diameter of the impeller is as measured between the tips. The tips 28 are curved so that they fit along sectors of the impeller diameter circle. The fins 26 are also curved so that they fit along sectors of the circle having the diameter of the impeller.

The blades 16, 18, 20 and 22 are each identical. Each blade is generally trapezoidal in shape and is wider at the tip 28 than at the base 24 thereof. The fins are generally rectangular and are symmetrically disposed about the blades, which extend diagonally of the fins. The fins extend from the pressure surface of the blades and also from the suction surface of the blades. The ends of the fins extend beyond the leading edges 32 and the trailing edges 34 of the blades. The leading edges are contoured in profile.

In the position shown in FIGS. 1–3, the impeller 10 is down pumping. The upper and lower ends 36 and 38 of the hub are conical. The impeller system may be reversed on the shaft when up pumping operation is desired as shown in FIG. 4. The impeller system is disposed in a vessel, such as a tank 39, containing the medium (the slurry) which is to be mixed or circulated. Preferably the impeller is located in a draft tube 40 (FIG. 4) within the tank 39. The draft tube is flared at the bottom 44 thereof and has a notch which defines an annular channel or way 46. The diameter of the impeller up to the tip 28 is approximately equal to the diameter of the draft tube 40. The fins 26 are disposed at the opening (mouth) of the way. The fins may extend into the way and be recessed therein. The draft tube is then assembled in sections, joined at the rim of the way, so that the impeller may fit into the way 46. The fins have a width measured between their top and bottom edges approximately equal to the axial length of the way except for clearances 48 and 50. Even though the clearances are small, the fins limit circulation of the medium in the tank 39 into the way thereby precluding significant erosion due to abrasive particles in the slurry at the fins 26.

A typical blade 18 is shown in FIGS. 3 and 4. The blade 18 is made of two plates or skins which are welded together by welds 50 and 52 at the leading edge 32 and the trailing edge 34 of the blade 18. Alternatively, the blade may be made of a single plate which is suitably curved (like the skin plates) in a press.

The blades have camber thickness and twist. At the base 24 the blades may be a sector of a circle having a diameter larger than the diameter of the hub 14. The blades are tilted so as to fit flush against the hubs. The blades may be welded to the hubs or attached thereto by suitable brackets.

The thickness of the blades is measured between the upper suction surface 52 and the lower pressure surface 54 thereof. The meanline 56 of the blade bisects the thickness (the cross-section) of the blade. The chord 58 of the blade extends between the intersection of the meanline and the leading and trailing edges 32 and 34. The camber is the maximum distance, indicated as H, in FIG. 3 between the meanline and the chord 58. Camber is expressed as the ratio of the maximum distance H to the chord length as a percentage. In the preferred embodiment of the blade the camber is 8% plus or minus 4% and is approximately uniform over the length of the blade between the tip and base region thereof. The camber at the hub may vary from uniformity at the hub to increase the strength of the blade at the hub connection. The chord angle is the angle between the chord 58 and a plane perpendicular to the axis of the impeller. The twist is provided, since the chord angle at the tip increases towards the base. The tip chord angle (TCA) is preferably about 22° and may vary suitably between 10° and 30°. The chord angle at the base or hub (hub chord angle - HCA) is preferably 43° and may vary over a range such that the twist varies 12° to 25° between the tip and the base or hub. The thickness of the blade is the maximum distance between the upper and lower surfaces 52 and 54 perpendicular to the meanline 56. The thickness is essentially constant over the length of the blade, and expressed as a ratio of the thickness distance to the chord length is preferably 10%. The thickness may vary from 6 to 14%. The thickness may be increased at the hub for increased mechanical strength.

As shown in FIG. 2 the illustrated blade has a width to impeller diameter ratio W/D, measured perpendicular to the radial line 60, bisecting the blade to the axis 30, as shown in FIG. 2 of 0.3 at the tip and 0.25 at the base. The differential in W/D between the tip and the base is preferably 0.05. The W/D ratio at the tip is 0.30 plus 0.10, minus 0.05. The W/D ratio at the base is 0.25 plus or minus 0.05.

The midpoint 62 of the meanline 56 (halfway between the leading edge 32 and the trailing edge 34) is symmetrically disposed with respect to the fin 26, as shown in FIG. 3. The distance between the upper and lower edges of the fin and the intersections of the midline with the leading and trailing edges are approximately equal. FIG. 3 also shows that the fin is disposed diagonally of the blade at the tip thereof. The rectangular fins fit within the way, as shown in FIG. 4 and enhance the head coefficient, especially when used in the draft tube 40, as shown in FIG. 4.

The herein described impeller system, because of the tip configuration thereof, provides high hydraulic efficiency and a head coefficient $k_\nu$ from about 3 to 10, as is shown in FIG. 5. FIG. 5 is calibrated in normalized units of flow and head. From the efficiency curve, it can be seen that over the range of head and flow where $k_\nu$ varies from 3 to 10, efficiencies exceed 40%.

From the foregoing description it will be apparent that there has been provided improved mixing apparatus which is capable of high head operation and high flow efficiency. Variations and modifications of the herein described apparatus, within the scope of the invention, will undoubtably suggest themselves to those skilled in the art. Accordingly the foregoing description should be taken as illustrative and not in a limiting sense.

I claim:

1. Apparatus for mixing or circulating a liquid or liquid suspension medium which comprises an impeller having a plurality of blades, each of said blades having a tip at the outer end thereof, said blades being rotatable about an axis, said impeller having a diameter which is the diameter of a circle described by the rotation of the tips of said blades about said axis, each of said blades having means for providing a head coefficient $k_\nu$ from about 3 to 10, at a hydraulic efficiency of at least 40%, where $$k_v = \frac{H_d}{V^2/2g}$$

where $H_d$ is the pressure head across the impeller, V is the average flow velocity of the medium across the diameter of the impeller, and g is the acceleration of gravity, means for rotating the impeller, said head coefficient being provided by said blades with each of said blades a leading edge, a trailing edge, opposite surfaces, and a base at the inner end thereof, each of said blades having a ratio of the width, measured between the leading and trailing edges thereof, to the diameter of said impeller from 0.30, +0.10 to −0.05 at said tip and 0.25±0.05 at said base, and with a fin disposed at the tip of each of said blades and extending above and below said opposite surfaces about the tip of each of said blades, the tip of each of said blades being arcuate along a sector of a circle centered at said axis, said fins being rectangular plates with upper, lower, forward, and rear edges and which are also arcuate and conforming to the tips on which said fins are disposed, said tips extending diagonally across said fins, and said fins being symmetrically disposed about said tips with the distances between the leading and trailing edges of said blade at said tips and the upper and lower edges of said fins being approximately equal and the distances between the leading and trailing edges of said blades at said tips and said forward and rear edges of said fins also being approximately equal.

2. The apparatus according to claim 1 wherein said fins extend forwardly and rearwardly beyond the leading and trailing edges of said tips, respectively.

3. Apparatus for mixing or circulating a liquid or liquid suspension medium which comprises an impeller having a plurality of blades, each of said blades having a tip at the outer end thereof, said blades being rotatable about an axis, said impeller having a diameter which is the diameter of a circle described by the rotation of the tips of said blades about said axis, each of said blades having means for providing a head coefficient $k_v$ from about 3 to 10, at a hydraulic efficiency of at least 40%, where $$k_v = \frac{H_d}{V^2/2g}$$

where $H_d$ is the pressure head across the impeller, V is the average flow velocity of the medium across the diameter of the impeller. and g is the acceleration of gravity, means for rotating the impeller, said head coefficient being provided by said blades each having leading edge a trailing edge, opposite surfaces, and a base at the inner end thereof, each of said blades having a ratio of the width, measured between the leading and trailing edges thereof, to the diameter of said impeller from 0.30, +0.10 to −0.05 at said tip and 0.25±0.05 at said base, and with a fin disposed at the tip of each of said blades and extending above and below said opposite surfaces about the tip of each of said blades, the tip of each of said blades being arcuate along a sector of a circle centered at said axis, said fins being rectangular plates which are also arcuate and conforming to the tips on which said fins are disposed, said tips extending diagonally across said fins, said blades each having camber, twist and thickness between the surfaces thereof, said blades each having a mean line which bisects the thickness of said blades, the intersection of said mean line with said leading and trailing edges at said tip being approximately equally distant from the edges of said fins above and below the opposite surfaces of said blades.

4. The apparatus according to claim 3 further comprising a draft tube coaxial with and encompassing said impeller.

5. The apparatus according to claim 4 wherein said draft tube has an annular way of diameter larger than the diameter of said impeller, said fins being disposed adjacent to said way.

6. The apparatus according to claim 5 wherein said fins extend radially into said way.

7. The apparatus according to claim 5 wherein the axial length of said fins is equal to the axial length of said way except for a clearance distance therebetween.

8. The apparatus according to claim 5 wherein the diameter of said blades at said tips is approximately equal to the diameter of said draft tube and said fins extend into said way a distance equal to the thickness of said tips.

9. The apparatus according to claim 5 wherein said fins are rectangular and of axial length equal to the axial length of said way except for clearance distances between the upper and lower walls of said way and the upper and lower edges of said fins, the diameter of said blades at said tips being approximately equal to the diameter of said draft tube.

10. The apparatus according to claim 3 wherein said blades each have thickness between the opposite surfaces thereof, and a chord between the inner sections of said meanline and said leading and trailing edges, said head coefficient providing means further comprising said blades having a camber of 8%±4%.

11. The apparatus according to claim 10 wherein said camber is approximately constant over the length of each said blades between the tip and base region thereof.

12. The apparatus according to claim 11 wherein the thickness of said blades is approximately 10%±4% of the maximum chord length.

13. The apparatus according to claim 10 wherein said head coefficient providing means further comprises said blades having twist such that the geometric pitch angle at the tip is in the range from 10° to 30° at the tips, which pitch angle increases by approximately 12° to 25° from the tip to the base.

14. The apparatus according to claim 10 wherein the leading edge of each of said blades has a contoured profile.

15. The apparatus according to claim 3 wherein said plurality of blades is at least three.

* * * * *